United States Patent [19]

Schupphaus

[11] Patent Number: 4,615,565

[45] Date of Patent: Oct. 7, 1986

[54] TUNNEL OR ROAD HEADER

[75] Inventor: Herbert Schupphaus, Bochum, Fed. Rep. of Germany

[73] Assignee: Gebr. Eickhoff Maschinenfabrik und Eisengiesserei mbH, Hunscheidtstrasse, Fed. Rep. of Germany

[21] Appl. No.: 635,404

[22] Filed: Jul. 30, 1984

[30] Foreign Application Priority Data

Aug. 17, 1983 [DE] Fed. Rep. of Germany ..... 3329703

[51] Int. Cl.[4] ..... E21C 27/60

[52] U.S. Cl. ..... 299/75; 299/76; 299/78

[58] Field of Search ..... 299/58, 56, 55, 57, 299/64, 73, 75, 78, 76

[56] References Cited

U.S. PATENT DOCUMENTS

| | | | |
|---|---|---|---|
| 3,306,663 | 2/1967 | Webster | 299/56 X |
| 3,467,436 | 9/1969 | Pentith et al. | 299/56 X |
| 4,390,211 | 6/1983 | Thompson | 299/57 |

*Primary Examiner*—Stephen J. Novosad
*Assistant Examiner*—Thomas J. Odar
*Attorney, Agent, or Firm*—Thomas H. Murray; Clifford A. Poff

[57] ABSTRACT

A tunnel or road header is provided with a caterpillar running gear and a portal frame. A cutter head means engageable with a tunnel face is mounted displaceably on the frame on a horizontal track extending transversely of the longitudinal direction of the roadway. The cutter head means consists of a shearing machine equipped with a carrier arm which is pivotal parallel to the rock face through more than 360° and a shearing drum which is carried by the carrier arm and which rotates about an axis extending toward the rock face and parallel to the roadway floor.

12 Claims, 3 Drawing Figures

TUNNEL OR ROAD HEADER

BACKGROUND OF THE INVENTION

This invention relates to a tunnel or road header apparatus for excavating or driving an underground roadway by a tunneling operation. The apparatus is equipped with a caterpillar running gear for moving along the roadway being excavated and a portal frame having a horizontal track which extends transversely of the longitudinal direction of machine movement along the roadway being driven. A cutter head is displaceably guided on the horizontal track for engagement with the tunnel face.

German patent specification No. 22 48 785 discloses a drifting and cutting machine equipped with a caterpillar running gear carrying a portal frame. This frame includes a cross member which extends transversely of the longitudinal direction of the roadway and carries a percussion tool held by a boom which is mounted so as to be three-dimensionally pivotal and rotatable about its longitudinal axis. The percussion tool is movable transversely of the longitudinal direction of the roadway on the cross member of the portal frame. Two other cross members are arranged parallel to one another on the portal frame and are spaced apart in the longitudinal direction of the face, and the mining equipment is traversable on the cross members.

German patent specification No. 12 34 170 discloses a road-driving machine comprising a machine frame which is displaceable in the longitudinal direction of the roadway being driven and a shearer head projecting toward the rock face. The shearer head is held by a guide rail which extends transversely of the roadway longitudinal direction over the width of the road. Two arms in the form of a link parallelogram carry the guide rail and are adjustable over the height of the roadway tunnel. The shearer head is mounted displaceably on the guide rail and can be guided over the entire roadway tunnel cross section.

While the system according to the first citation mentioned above allows completely free access to the rock face over the entire roadway width so that it is possible to remove the spoil by means of a loader traversable independently of the drifting machine, the system according to the latter citation requires a conveyor extending over the roadway width to receive the spoil. In both cases, therefore, the devices which carry the breaking tool or its guide rail are relatively far away from the rock face due to the long reach of the percussion tool or the transverse conveyor means required to remove the spoil.

SUMMARY OF THE INVENTION

An object of the present invention is to provide a tunnel or road header with a shearing drum which can accurately cut the required roadway tunnel profile and then remove the spoil accumulating on the roadway floor to the middle of the roadway and into the reach of a conveyor extending in the longitudinal direction of the roadway.

In one preferred embodiment, the invention comprises a tunnel or road header apparatus of the kind indicated hereinabove and having its shearing drum axis of rotation extending perpendicularly to the rock face and parallel to the roadway floor. The apparatus is able to cut out cleanly the entire roadway contour with the shearing drum axis parallel to the roadway longitudinal direction and after completely breaking out the rock face can push the accumulating spoil, simply by means of the shearing drum, to the middle of the roadway where it is received and removed by the header conveyor. Accordingly, there is no need for a separate transverse conveyor which obstructs access to the rock face and hence complicates control of the breaking tool and impedes tunneling progress.

The invention also provides for the portal frame carrying and guiding the shearing drum to be supported firmly and substantially without vibration on the roadway floor in the immediate vicinity of the rock face, and this feature also contributes greatly to accurate tunnel profile cutting by the shearing drum.

Another aspect of this invention is a forwardly-projecting running gear chassis which extends forwardly of and diverges outwardly of the caterpillar tracks. This not only increases the machine stability and gives a very stable support in that area in which the shearing drum is operative, but in addition the range of action of the shearing drum is so increased that it can cut over the entire width and height of the machine and, given an appropriately-dimensioned shearing drum carrier arm, can work roadway cross sections of large dimensions. The portal frame and the caterpillar running gear, which are in this case interconnected by the running gear chassis, form a structural unit which enables the front area of the two caterpillar tracks to be raised by means of extensible supports incorporated in the portal frame. This feature further enhances machine stability.

Advantageously, the shearing drum is supported by a carrier arm which is, in turn, supported within a housing that is guided for movement along a track. The housing is formed with a bore whose axis extends toward the tunnel rock face. A cylindrical bushing rotatably mounts the shearing drum carrier arm in the housing bore and, at the end of the bushing remote from the rock face, a driving connection is provided between the bushing and a drive motor associated with the housing to produce a pivoting movement of the drum carrier arm.

The bushing has an axial bore which receives therein the shearing drum drive motor. The drive motor for the shearing drum is disposed inside the bushing bore where it is mounted with the end thereof remote from the rock face rigidly connected to the housing by means of a torque stay. A construction of this kind for the housing gives a very compact machine frame which occupies little space inside the portal and does not obstruct the removal of spoil from the rock face.

Advantageously, a winch motor is associated with the housing on the side thereof remote from the tunnel face, i.e., behind the horizontal track, to engage a drive gearwheel in an elongated rack which extends over the length of the horizontal track. This means that while the overall cross-sectional profile of the machine is not unnecessarily increased, the machine can nevertheless traverse in either lateral direction inside the portal without obstruction.

A tubular guide rail extends parallel to the horizontal track and is secured to the forward end face of a container carried by the running gear chassis. The container is intended to receive the hydraulic and dust-extraction equipment, and to guide the housing equipped with the breaking tool so that the housing is additionally transversely displaceable without being obstructed in its mobility as a result.

One exemplified embodiment of the invention is explained in detail in the following description with reference to the accompanying drawings, wherein.

Figure 1:
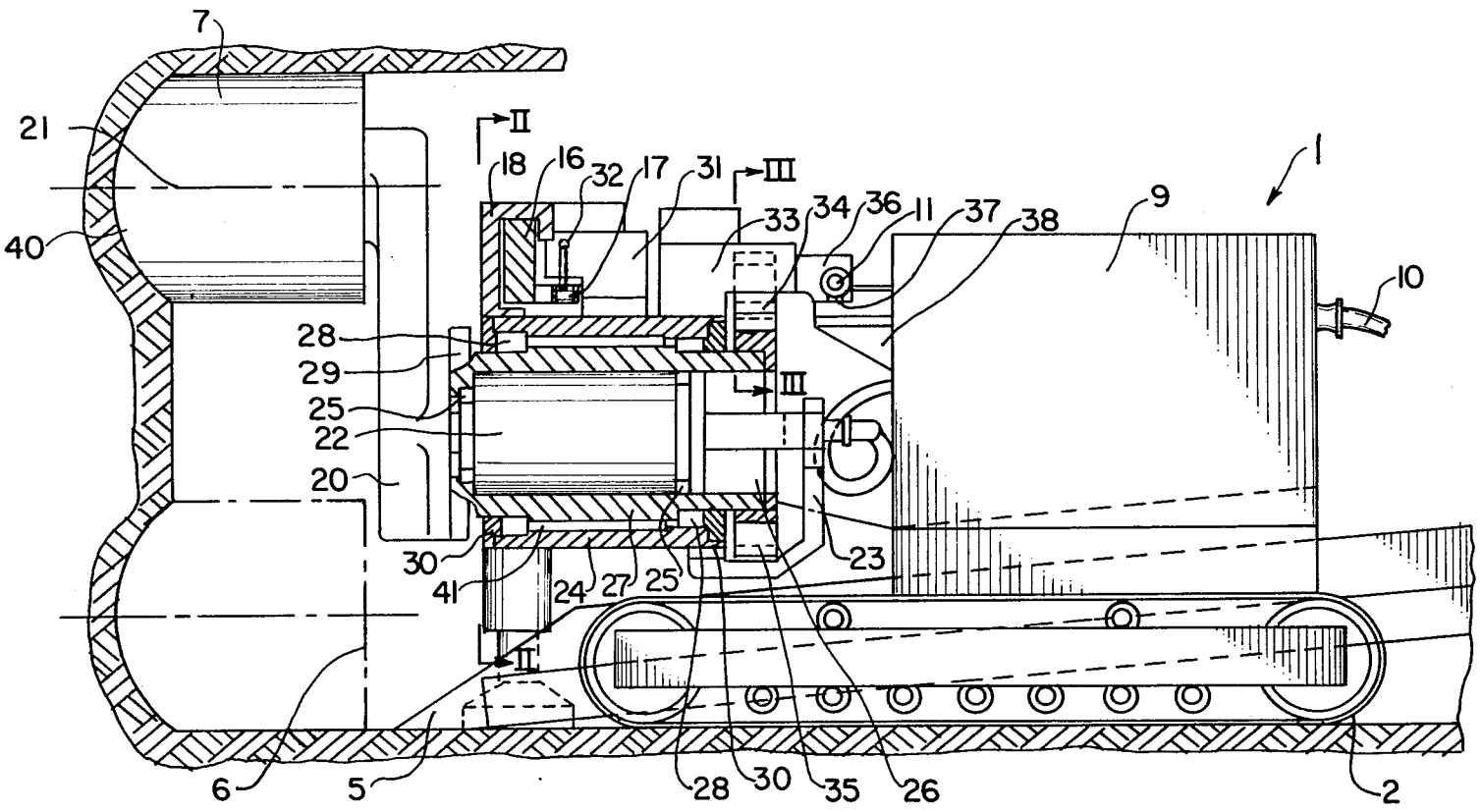
FIG. 1 is a side elevation of a tunnel header according to the invention shown partially in section.
Figure 2:
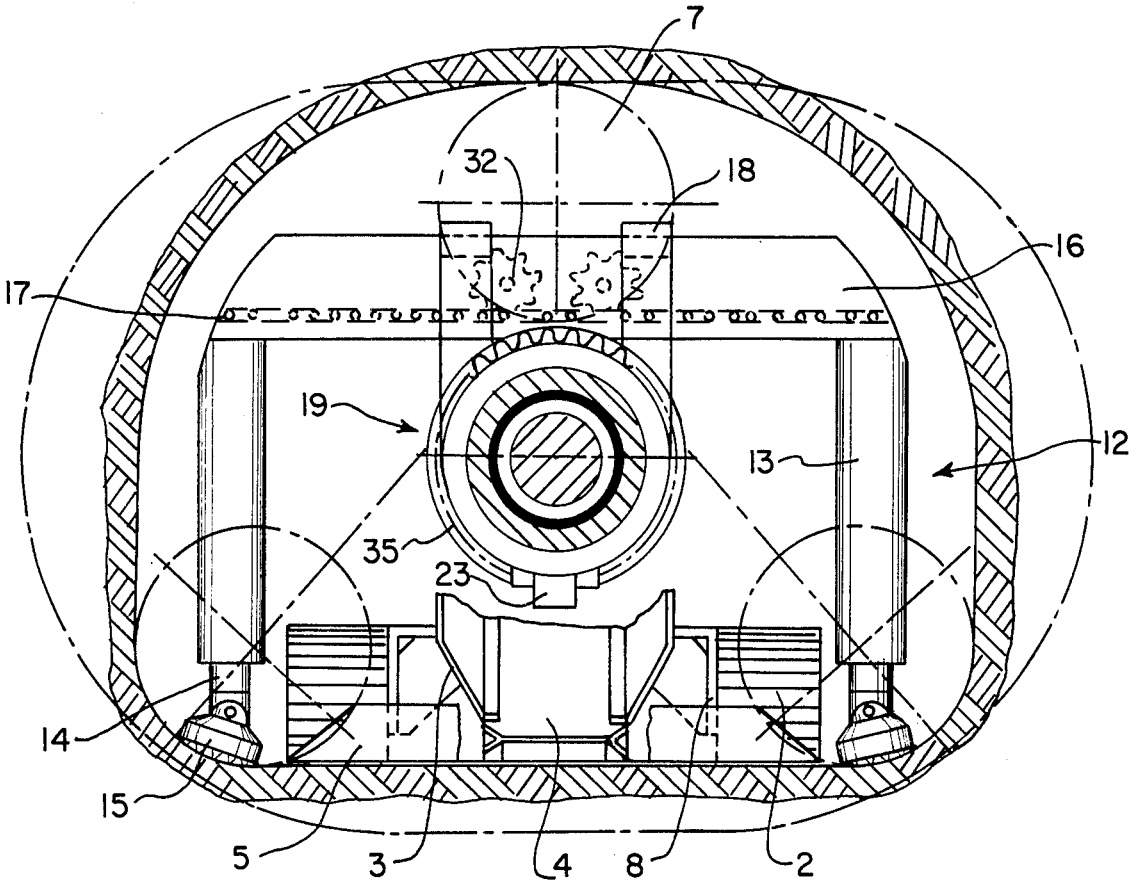
FIG. 2 is a transverse section taken on line II—II through that part of the machine according to FIG. 1 which bears the breaking tool.
Figure 3:
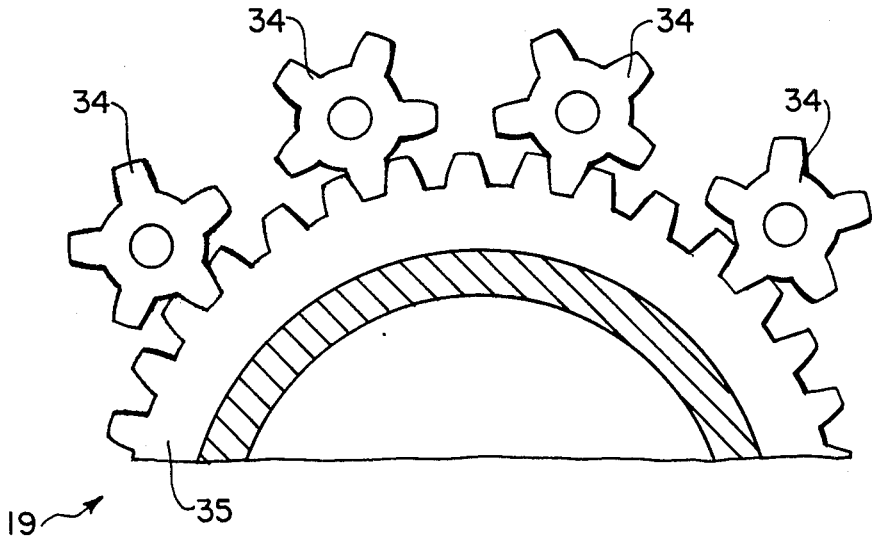
FIG. 3 is a fragmentary sectional view taken on line III—III of FIG. 1.

There is shown in FIG. 1, a tunnel or road header generally denoted by 1. Header 1 comprises caterpillar running gear 2 including a pair of caterpillar tracks. Between the two caterpillar tracks there is disposed a stage loader 4 provided with forward spill plates 3. Near the tunnel face, the loader 4 terminates in a loading shovel 5 which extends over the entire width of the caterpillar running gear 2 and substantially as far forward as the rear end face 6 of a shearing drum 7 which is operable to cut the road profile.

On the side of the header 1 remote from the shearing drum, the chassis 8 is equipped with a container 9 which accommodates all the hydraulic, dust extraction and power supply means. Power is fed to the header 1 via the cable 10. A tubular guide rail 11 carried on the end of container 9 which faces the tunnel face extends laterally of and generally parallel to the tunnel face.

A portal frame, generally indicated at 12, is disposed adjacent the forward end of the running gear, which normally is adjacent the rock face, and is rigidly connected to the chassis 8 of the caterpillar running gear 2. In its operating position, frame 12 rests on the tunnel roadway floor by means of extensible (e.g., fluid powered) supports 13 and feet 15 mounted pivotally on the lower or free ends of piston rods 14. The supports 13 thus are of variable length through the agency of the piston rods 14, such that they support a transversely-elongated track 16 extending therebetween so that it is vertically adjustable. Track 16 is equipped, on the tunnel face side thereof, with a rack 17 extending horizontally over its length. A machine frame, generally indicated at 19, is guided on track 16 by means of two runners 18 which partially engage around the track 16. Machine frame 19 is provided with a drum support arm 20 which extends parallel to the rock face and which is pivotal through more than 360° about an axis which extends longitudinally of header 1. At its outer end, arm 20 carries a cylindrical shearing drum 7 which is rotatable about an axis 21 extending longitudinally of header 1 and generally parallel to the roadway floor. On the tunnel face side thereof, the shearing drum 7 merges into a spherical end ring member 40 (not shown in detail).

Shearing drum 7 is driven in rotation by a drive connection to an electric motor 22 which resides within a bushing 27 that rotatably supports the arm 20. The end of motor 22 which is remote from the tunnel face is rigidly connected to a housing 24 of machine frame 19 by means of a torgue stay 23. Electric motor 22 is supported by two roller bearings 25 within a bore 26 formed in bushing 27 which is, in turn, mounted rotatably by two roller bearings 28 within a through bore 41 extending within housing 24. The arm 20 is detachably secured to a collar 29 adjacent the forward end of bushing 27. The ends of bore 41 of the housing 24 are closed by bolts on covers 30 so as to be dustproof. Machine frame 19 can be moved transversely of the roadway along track 16 by means of two winch motors 31 which are associated with housing 24 and each having a drive wheel 32 which engages rack 17 connected to the track 16.

The pivoting movement of arm 20 is produced by four drive motors 33 which are mounted adjacent the rearward end of housing 24 remote from the tunnel face. Each motor 33 has a gearwheel 34 which engages a gear ring 35 that is bolted to the adjacent or rearward end of the bushing 27.

As described above, the arm 20 carrying the shearing drum 7 is secured to bushing 27 adjacent the forward end thereof for rotation with the bushing 27 under the impetus of drive motors 33. A guide runner 36 engages around the tubular guide rail 11 of container 9 and is secured to the housing 24 near the drive motors 33 to guide machine frame 19 in transverse movement thereof. An extension 37 of the runner 36 rests on a track 38 carried by the container 9 beneath the guide rail 11 and extending in the direction of travel of machine frame 19 with respect to container 9.

Cables (not shown) extending from the container 9 supply power both to the two winch motors 31 and to the four drive motors 33 for producing the pivoting movement and lateral translation of the arm 20.

According to the description hereinabove, a new and improved tunnel or roadway header is provided by the instant invention. Since alternative and modified embodiments of the invention may be suggested to those versed in the art, it is intended that the invention be construed broadly and limited only by the scope of the claims appended hereto.

I claim as my invention:

1. A tunnel driving apparatus comprising:

a running gear chassis including ground-engaging means for traverse of said tunnel driving apparatus along the ground, a carrier frame assembly connected to said running gear chassis adjacent a forward end thereof and adapted to be positioned adjacent a tunnel face, said carrier frame assembly including extensible supports and a horizontal track supported thereby for vertical adjustment of the track position upon extension and retraction of said supports in contact with the ground, a shearing machine including a frame having a housing guided for traversing movement longitudinally along said track, said shearing machine further including a carrier arm pivotally supported by said housing, drive means carried by said frame for pivoting said carrier arm about an axis of rotation extending transversely of said track to permit rotation thereof generally parallel to the tunnel face, a rotary shearing drum supported by said carrier arm adjacent a free end thereof for removing material from the tunnel face, said track extending generally laterally of said tunnel driving apparatus to permit said shearing machine to be traversed laterally across the tunnel face, and a shearing drum drive motor carried by said housing for rotating said rotary shearing drum about an axis spaced laterally from said axis of rotation of said carrier arm.

2. A tunnel driving apparatus according to claim 1 wherein said running gear chassis projects forwardly and laterally outwardly of said ground-engaging means and the forward end thereof is connected to said extensible supports of said portal frame.

3. A tunnel driving apparatus according to claim 2 wherein said extensible supports are situated laterally outward of the outer contour of said ground-engaging means.

4. A tunnel driving apparatus according to claim 1 wherein said housing includes a through bore formed on an axis extending traversely of said track and generally parallel to the ground, said bore having rotatably disposed therein an elongated bushing which extends outwardly of the ends of said bore and has said drum carrier arm mounted adjacent a forward end portion thereof, and a driving means drivingly connected with an end portion of said bushing opposite the end mounting said carrier arm to thereby provide rotary motion of said carrier arm.

5. A tunnel driving apparatus according to claim 4 wherein shearing drum drive motor is disposed within a bore formed within said bushing and a driving connection thereof to said shearing drum extends within said carrier arm.

6. A tunnel driving apparatus according to claim 5 wherein a torque stay disposed adjacent the rearward end of said shearing drum drive motor rigidly secures said shearing drum drive motor with respect to said housing.

7. A tunnel driving apparatus according to claim 6 wherein said track includes an elongated rack, and a winch motor means associated with said housing includes a drive gearwheel which is engageable in driving engagement with said rack.

8. A tunnel driving apparatus according to claim 7 wherein a container means is disposed on said running gear chassis and includes a forward face on which is mounted a guide rail which extends parallel to said track and on which said housing is guided for movement transversely of said chassis.

9. A tunnel driving apparatus according to claim 8 wherein said drum axis extends toward the tunnel face and generally parallel to the ground.

10. A tunnel driving apparatus according to claim 9 wherein said drive means includes drive motor means which are fixed with respect to said housing.

11. A tunnel driving apparatus according to claim 10 wherein said drive motor means includes a plurality of drive motors.

12. A tunnel driving apparatus according to claim 11 wherein said ground-engaging means includes a pair of caterpillar tracks.

* * * * *